US005626077A

United States Patent [19]

Muller

[11] Patent Number: 5,626,077

[45] Date of Patent: May 6, 1997

[54] METHOD FOR CONTROLLING SHEET FEED

[75] Inventor: Joachim Muller, Pullach, Germany

[73] Assignee: MAN Roland Druckmaschinen AG, Germany

[21] Appl. No.: 601,874

[22] Filed: Feb. 15, 1996

[30] Foreign Application Priority Data

Feb. 18, 1995 [DE] Germany ..... 195 05 560.8

[51] Int. Cl.[6] ..... B41F 1/66; B41F 33/04; B41F 33/06

[52] U.S. Cl. ..... 101/484; 271/262; 271/263; 271/265.04

[58] Field of Search ..... 271/262, 263, 271/265.04; 101/484

[56] References Cited

U.S. PATENT DOCUMENTS

| | | | |
|---|---|---|---|
| 2,852,250 | 9/1958 | George | 271/263 |
| 4,420,747 | 12/1983 | Kistner . | |
| 4,581,993 | 4/1986 | Schoneberger . | |
| 4,753,433 | 6/1988 | Rodi et al. | 271/265.04 |
| 4,878,428 | 11/1989 | Watarai | 271/262 |
| 5,186,105 | 2/1993 | Emrich et al. . | |
| 5,272,975 | 12/1993 | Dettinger et al. . | |
| 5,503,382 | 4/1996 | Hansen et al. | 271/3.03 |

FOREIGN PATENT DOCUMENTS

| | | | |
|---|---|---|---|
| PS1060409 | 1/1965 | Germany . | |
| 2940631C2 | 4/1984 | Germany . | |
| 2930270C2 | 4/1986 | Germany . | |
| 0048741 | 2/1989 | Japan | 271/263 |

*Primary Examiner*—Edgar S. Burr
*Assistant Examiner*—Amanda B. Sandusky
*Attorney, Agent, or Firm*—Leydig, Voit & Mayer, Ltd.

[57] ABSTRACT

A method for controlling the sheet feed in an offset printing machine. A controller, in conjunction with various sensing devices, is utilized to determine the presence of double or misfed sheets as the sheets are removed from a sheet stack in a feeder unit of the printing machine. The controller then, through various actuating devices, shuts down various printing machine functions in order to complete the printing of the sheets ahead of the double or misfed sheets.

3 Claims, 1 Drawing Sheet

METHOD FOR CONTROLLING SHEET FEED

BACKGROUND OF THE INVENTION

1. Field of the Invention

The present invention relates to a method for controlling sheet feed in a sheet-fed offset printing machine, and more particularly, to a method for controlling sheet feed in a sheet-fed offset printing machine wherein printing continues just prior to a misfed or double sheet entering the printing machine.

2. Discussion of the Related Art

In currently utilized sheet-fed offset printing machines, the sheets are removed from a feeder stack, transported over a conveyor table (suction tape table) to a stop, aligned, and then gripped by a pre-gripper and transferred to a first printing unit. In order to avoid an in-register print of the subject with reference to the printed sheet and machine damage as a result of sheets being drawn in a faulty manner, a monitoring of the sheet run by means of sensors is carried out at various locations in the above-described conveying path.

Thus, it is known that, shortly after the uppermost sheet has been lifted from the feeder stack, the imbricated sheet stream should be monitored for the presence of double sheets. For the purpose of controlling double sheets in the imbricated sheet stream, use is made, in particular, of scanning control devices. If, shortly after the individualization and after the uppermost sheet has been lifted from the feeder stack, a double sheet is detected, an immediate blocking of the stop and of the pre-gripper is implemented, as well as the stopping of the feeder by disengaging a clutch which connects the feeder to the drive of the printing machine. The last sheet drawn into the machine before detection of a double sheet is then still printed out, whereupon the throwing off of the blanket cylinders in the individual printing units is initiated in the correct sequence, that is to say in accordance with the sheet run. Likewise, the ink feed and damping solution feed to the printing plates in the individual printing units is also switched off.

A monitoring device for the feed of sheets, which is arranged directly downstream of the feeder stack in the conveying direction of the sheets and is used to detect double sheets, is disclosed by DE 2 930 270 C2. In DE 2 930 270 C2, the device has a driven transport roller and a scanning roller which is mounted so as to be movable with respect to the transport roller, the sheets being conveyed between these rollers.

The stopping of the feeder, which is initiated immediately in accordance with the method described above, the switching off of printing and the switching off of the ink feed and damping solution feed have, for the first two printing units specifically, a disadvantage associated therewith in that the ink flow and damping solution flow are interrupted abruptly following the last sheet which has run into the machine and been printed. If then, following the elimination of the cause of the disturbance (removal of the double sheet from the sheet stream), a sheet is once more conveyed into the machine, the previous inking and damping of the printing plates and of the blankets results in over-inking, which is only dissipated over several sheets, which means that rejects occur, i.e., poor quality prints.

A further disadvantage associated with the sheet conveying being stopped immediately after detection of a double sheet or misfed sheet directly after the sheet conveying downstream of the feeder stack is that the printer has to clear away all the imbricated sheets, for example, the 5 to 7 sheets which lie between the stop and the transport roller, and the printer has to remove the cause of the stoppage, that is to say the double sheet. It is precisely thin and sensitive printed materials which are often damaged during this removal operation, so that rejects may also occur at this point.

SUMMARY OF THE INVENTION

The present invention is directed to a process for controlling the sheet feed in an offset printing machine. The process comprises transporting sheets from a feeder stack of a feeding unit over a predetermined conveyance stretch to the printing machine, detecting the presence of double or misfed sheets within the predetermined conveyance stretch, and terminating the transporting of the sheets from the feeder stack to the printing machine upon the detection of double or misfed sheets. The process also comprises conveying the sheets preceding the detected double or misfed sheets into the printing machine, terminating the ink feed in the printing machine prior to the conveyance of a last sheet preceding the double or misfed sheets into the printing machine, and then stopping the conveying of the sheets into the printing machine when the double or misfed sheets reach the printing machine.

According to the invention, it is provided that, after detection of a double sheet or misfed sheet just downstream of the feeder stack in the conveying direction of the sheets, the sheets lying in front of this double sheet or misfed sheet are still conveyed into the printing machine and the stop is blocked only when the last correctly positioned sheet in front of the double sheet or misfed sheet has run into the machine. Use is therefore made of the fact that about 5 to 7 sheets are located on the conveyor table in front of the double sheet or misfed sheet in the imbricated set and can hence still be fed correctly and even printed. The double sheet or misfed sheet causing the stoppage can then be removed by the printer at the stop, as a rule the sheets following the double sheet or misfed sheet once more lying correctly in the imbricated set, so that only a minimum number, in particular only the double sheet or misfed sheet itself, have to be removed by the printer.

As a result of the fact that, after detection of the double sheet or misfed sheet, a number of sheets which corresponds to the degree of imbrication and to the length between sheet-scanning means and stop can still be fed to the printing machine, it is possible, in particular in the first and second printing units, for the ink feed or damping solution feed to be turned off a predetermined number of revolutions before the drawing in of the last sheet resting correctly against the stop. Hence, ink is still taken up from the rubber blanket and printing plate, so that an excessive quantity of ink, which leads to over-inking of the first sheet when starting up once more, is avoided.

BRIEF DESCRIPTION OF THE DRAWINGS

Exemplary embodiments of a method for controlling sheet feed in accordance with the present invention is described below with reference to the accompanying drawings in which.

DETAILED DESCRIPTION OF THE PREFERRED EMBODIMENTS

Figure 1:
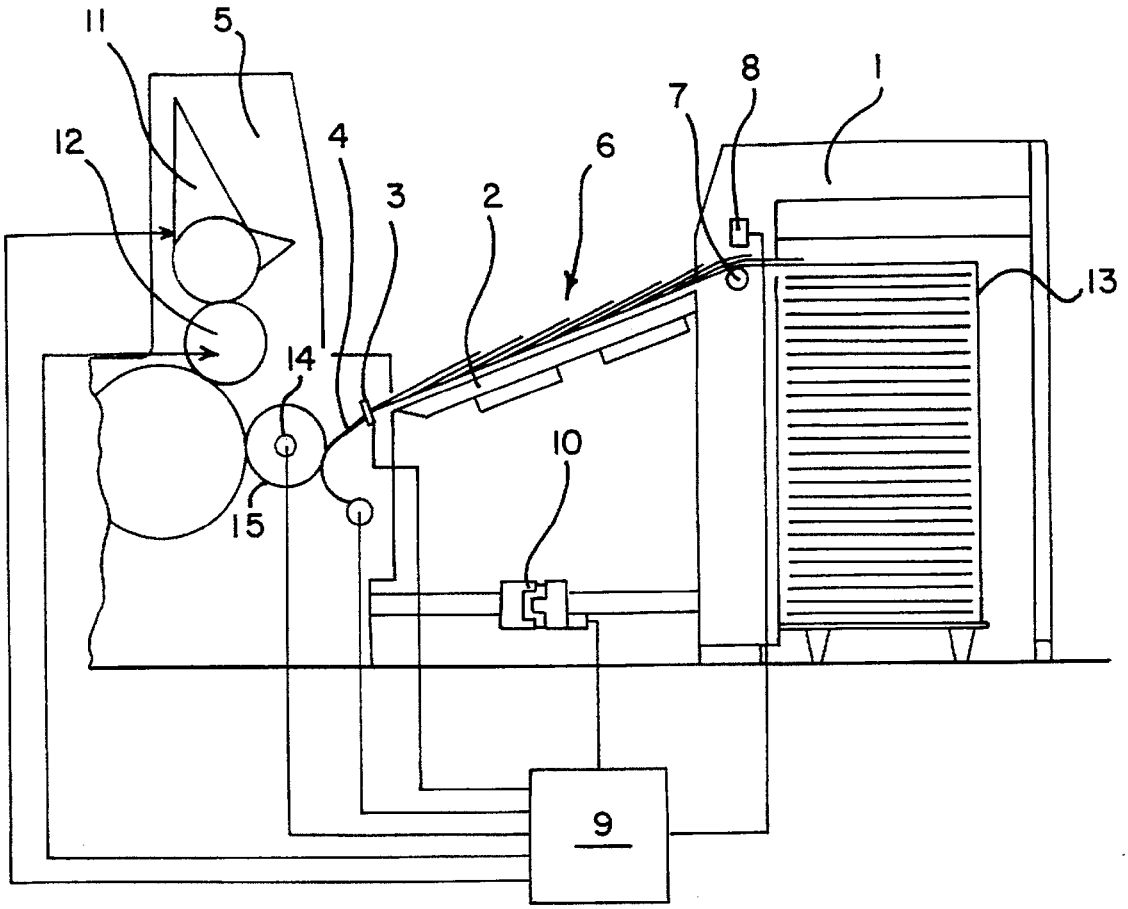
FIG. 1 is a diagrammatic representation of a feeder and a first printing unit 5 of a feeder and a first printing unit of a sheet-fed offset printing machine.

A method for controlling sheet feed in accordance with the present invention may be utilized in sheet-fed offset printing machines. FIG. 1 illustrates a feeder unit 1 and a first printing unit 5 of an exemplary sheet-fed offset printing machine. Sheets are removed from a top side of a feeder stack 13 in the feeder unit 1 by a transport mechanism, not illustrated, and are conveyed over a transport roller 7 onto a conveyor table 2 designed as a suction tape table. The transport arrangement may comprise any arrangement suitable for transferring sheets from the feeder stack 13 to the printing unit 5. An exemplary transport arrangement is disclosed in U.S. Pat. No. 4,420,747, assigned to the same assignee as the present invention and incorporated by reference herein. The sheets 6 on the top side of the conveyor table 2 are then conveyed by suction tapes in an imbricated fashion to a stop 3 where, after an alignment process and once correct positioning of the sheet 6 has been verified, the sheet 6 is seized by a pre-gripper 4 and accelerated to the circumferential speed of the cylinders in the printing unit 5. The sheets 6 may be aligned in accordance with the method disclosed in U.S. Patent No. 5,186,105, assigned to the same assignee as the present invention and incorporated by reference herein. Verification of the correct positioning of the sheets 6 may be made by sheet sensors, for example, optoelectronic sensors such as described in U.S. Patent No. 5,186,105.

Arranged in the conveying direction of the sheets 6, in the region of the transport roller 7 of the feeder unit 1, is a sheet control 8, which operates in conjunction with the transport roller 7 and which checks for correct sheet individualization. Essentially, the sheet control 8 determines if individual sheets 6 are being transported over the conveyor table 2 in an imbricated fashion, or if there is a complete overlap of two or more sheets, e.g., double sheets. The sheet control 8 is coupled to a controller 9, which is described in detail subsequently. If a plurality of sheet controls 8 are arranged over the format width or over the length of the transport roller 7, the detection of oblique sheets can also be carried out at this point.

The sheet control 8 may comprise an optical sensor or a roller detector. A roller detector typically includes two rollers, one of which is forcibly flexed against the other. The distance between the two rollers corresponds to the thickness of the sheet lying between the two rollers and is measured by a displacement transmitter. The signal from the displacement transmitter is fed to an electronic evaluation circuit. If the signal from the displacement transmitter is indicative of a thickness greater than the distance corresponding to the thickness of a single sheet, then the electronic evaluation circuit outputs a signal indicative of the presence of multiple sheets. An exemplary roller detector is disclosed in U.S. Pat. No. 4,420,747. The signal from the electronic evaluation circuit is input to the controller 9, which utilizes this signal as part of the process for controlling sheet feed. Alternatively, an optical sensor may be utilized to determine the presence of completely overlapped sheets.

A specific number of sheets 6 are located on the conveyor table 2. The number of sheets 6 on the conveyor table 2 may be determined based on the format length of the sheets 6, the degree of imbrication, and the distance between the stop 3 and the transport roller 7. In the example shown, this is six sheets, if the end of the uppermost sheet has left the transport roller 7 and the lowermost sheet is resting against the stop 3.

In order to illustrate the method for controlling sheet feed according to the present invention, it is assumed, in accordance with the illustration of the figure, that the sheet 6 located between the transport roller 7 and the sheet control 8 is a double sheet. Accordingly, the sheet control 8 detects the presence of the double sheet and outputs a signal indicative of the presence of the double sheet to the controller 9. Based on the format length of the sheets 6, the degree of imbrication, and the distance between the stop 3 and the transport roller 7, it is possible to calculate how many sheets 6 can still run over the conveyor table 2 into the first printing unit 5 of the sheet-fed offset printing machine without the double sheet entering the printing unit 5. This calculation is made by the controller 9 as is explained below. In the exemplary embodiment illustrated in FIG. 1, there are six sheets illustrated between the double sheet and the stop 3.

Upon detection by the sheet control 8 of the double sheet in the region of the transport roller 7, a sheet individualization means, not illustrated, of the feeder unit 1 is switched off by a command from the controller 9. The transport mechanism disclosed above and described in detail in U.S. Pat. No. 4,420,747 comprises a sheet feeder mechanism including a sucker for picking up individual sheets from a feed pile, such as the feeder stack 13 illustrated in FIG. 1. The sucker and its associated hardware comprise the sheet individualization means of the present invention. The controller 9 may be coupled to the sheet individualization means via any suitable interface device such as a solenoid switch. Accordingly, once the controller 9 receives a signal from the sheet control 8 indicating a double sheet has been detected, the controller 9 outputs a command to the solenoid switch to terminate the operation of the sheet individualization means. The six sheets 6 lying in front of the double sheet on the conveyor table 2 are now conveyed into the printing unit 5 by means of the pre-gripper 4, until the double sheet has reached the stop 3. When the double sheet has reached the stop 3, the controller outputs commands to the stop 3 and the pre-gripper 4 to terminate operation; accordingly, all sheets 6 on the conveyor table 2 which may properly be printed are fed into the printing unit 5 and the double sheet is stopped. The controller 9 may be connected to the stop 3 and the pre-gripper 4 by any suitable means, for example, solenoid switches.

As stated above, based on the format length, the degree of imbrication, and the distance between the stop 3 and the transport roller 7, the number of sheets ahead of the double sheet may be determined by the controller; accordingly, based upon this determination, the controller 9 outputs the termination commands to the stop 3 and the pre-gripper 4.

At this point, the controller 9 has terminated the operation of the sheet individualization means so that no additional sheets are fed from the feeder unit 1, the sheets remaining on the conveyor table 2, ahead of the double, have been fed into the printing unit 5, and the controller 9 has terminated the operation of the stop 3 and the pre-gripper 4 to prevent the double sheet from entering the printing unit 5. Accordingly, the six sheets 6 which have been fed into the printing unit 5 may be printed upon.

The number of sheets which may be printed by the machine, and hence the number of print cycles, may be determined by the number of revolutions of the rollers in the printing unit 5. For example, the number of sheets 6 which may be possible to convey into the machine may be determined by an incremental or absolute angle encoder 14 which is mounted in a single-turn shaft 15 of the printing unit 5. The angle encoder 14 determines the number of revolutions of the rollers in the printing unit 5. An exemplary angle encoder is disclosed in U.S. Pat. No. 4,581,993, assigned to the same assignee as the present invention and incorporated by reference herein.

In a typical offset printing machine, a printing plate is mounted on a plate cylinder. Ink is applied to the printing plate via an inking unit. The printing plate, however, does not directly contact the sheets fed through the printing machine, rather, the ink from the printing plate is transferred to a rubber blanket mounted on a blanket cylinder. In order to aid in the transfer of ink from the printing plate to the rubber blanket, the printing plate is dampened by dampening fluid from a damping unit. To produce a print on the sheets, the sheets are conveyed over a back-pressure cylinder which cooperates with the blanket cylinder. A detailed description of an exemplary printing machine is given in U.S. Pat. No. 4,581,993.

The controller 9 is connected to the inking unit 11 via an inking unit switching device, not illustrated. The inking unit switching device comprises any device suitable for controlling the operation of the inking unit 11. For example, the inking unit switching device may comprise a solenoid valve and a double-acting fluid/air pressure cylinder. The inking unit switching device functions to throw on and throw off the ink applicator rollers so as to either apply ink to the plate cylinder or to withhold ink from the plate cylinder, as well as to block and release the movement of an ink feed roller. The inking unit switching device receives commands from the controller 9 as part of the sheet feed process. The controller 9 is connected to the damping solution unit via a damping unit switching device, neither of which is illustrated. The damping unit switching device may be identical to the inking unit switching device. The damping unit switching device functions to provide or inhibit the flow of damping solution in response to commands from the controller 9 as part of the sheet feed process. The controller 9 is also connected to a switching means operable to throw on and throw off the blanket cylinder with respect to the back-pressure cylinder and the plate cylinder. Exemplary switching devices and means and their operation are disclosed in U.S. Pat. No. 5,272,975, assigned to the same assignee as the present invention and incorporated by reference herein.

After detection of the double sheet in the region of the transport roller 7 by means of the sheet control 8, and after the subsequent switching off of the sheet-individualization means, an interruption of the ink feed of the inking unit 11 is carried out after a predetermined number of single-turn revolutions, that is to say while the correctly conveyed sheets 6 preceding the double sheet are still running into the machine as describe above. The interruption of the inking unit 11 is caused by a command from the controller 9. The command for interruption of the inking unit 11 is based upon a determination of the number of sheets remaining to be printed based upon information from the angle encoder 14. Then, after the last correctly conveyed sheet preceding the double sheet has been printed by the blanket cylinder 12, that is to say while the double sheet has arrived at the stop 3, the throwing off of the blanket cylinder 12 from the back-pressure cylinder and from the plate cylinder lying above the latter is carried out via commands from the controller 9. For example, provision can be made for the last sheets preceding the last of the double sheets still to be printed by the blanket cylinder 12, the ink feed of the inking unit 11 to the plate of the plate cylinder lying above having already been interrupted. A removal of ink is thus carried out by means of the two last sheets. The switching times at which the controller 9 initiates the processes outlined above follow from the design of the printing machine and also from empirically obtained specifications. The latter is true, in particular, for the number of sheets which are still printed by the blanket cylinder 12 when the ink feed of the inking unit 11 has been interrupted.

The controller 9 is also connected to a feeder clutch 10, by means of which the feeder 1, which is driven by the drive of the printing machine, can be stopped. The switching, that is to say the disengaging, of the feeder 1 from the drive of the printing machine is in this case carried out precisely at the time when the last sheet lying in front of the double sheet has been conveyed into the machine and the double sheet has come to a standstill at the stop 3.

The above sequence is initiated in a corresponding manner in the remaining printing units, not shown, of a multicolor offset printing machine. In particular, the procedure in the individual printing units is such that the last two sheets to be printed are printed by the blanket cylinder in all the printing units, the ink feed in the associated inking units already having been turned off. Thus, in the event of starting up the printing machine once more, the same conditions are obtained in all the printing units with respect to the remaining layer thicknesses on the plate cylinders and blanket cylinders.

Figure 2:
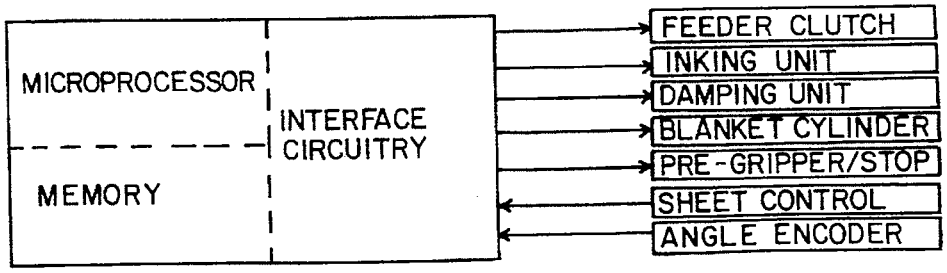
FIG. 2 is a block diagram of a controller for a sheet-fed offset printing machine.

The controller 9 implements the above described sheet feeding process. The controller 9 may comprise a hardware controller, a software controller, or a combination hardware/software controller. In the preferred embodiment, the controller 9 comprises a hardware/software controller. FIG. 2 is a block diagram representation of an exemplary controller 9. The exemplary controller 9 comprises a microprocessor 20, memory 22, and interface circuitry 24. The memory 22 comprises the software to implement the above-described sheet feed process. The interface circuitry 24 includes all the circuits for the communication of information and commands between the controller 9 and the devices to which the controller 9 is connected. For example, the interface circuitry 24 comprises analog-to-digital converters for converting the analog signals from the sheet control 8 and the angle encoder 14 into digital format signals for the microprocessor 20. The interface circuitry also comprises digital-to-analog converters for converting the commands output from the microprocessor 20 into analog format signals which may be implemented by the various devices connected to the controller 9, for example, the pre-gripper 4.

Although shown and described is what is believed to be the most practical and preferred embodiments, it is apparent that departures from specific methods and designs described and shown will suggest themselves to those skilled in the art and may be used without departing from the spirit and scope of the invention. The present invention is not restricted to the particular constructions described and illustrated, but should be construed to cohere with all modifications that may fall within the scope of the appended claims.

I claim:

1. A process for controlling the sheet feed in an offset printing machine comprising:

transporting sheets from a feeder stack of a feeding unit over a predetermined conveyance stretch to the offset printing machine;

detecting the presence of double or misfed sheets within the predetermined conveyance stretch;

terminating the transporting of sheets from the feeder stack to the offset printing machine upon the detection of double or misfed sheets;

conveying the sheets preceding the detected double or misfed sheets into the offset printing machine;

terminating the ink feed in the offset printing machine prior to the conveyance of a last sheet preceding the double or misfed sheets into the offset printing machine; and stopping the conveying of the sheets into the offset printing machine when the double or misfed sheets reach the printing machine.

2. The process for controlling the sheet feed in an offset printing machine according to claim 1 further comprises calculating the number of sheets preceding the detected double or misfed sheets.

3. The process for controlling the sheet feed in an offset printing machine according to claim 2, wherein the number of sheets preceding the detected double or misfed sheets is calculated as a function of a format length of the sheets, the degree of imbrication of the sheets, and the length of the predetermined conveyance stretch.

* * * * *